United States Patent [19]

Johansen

[11] Patent Number: 4,472,839

[45] Date of Patent: Sep. 25, 1984

[54] CUMMERBUND

[75] Inventor: Mary V. Johansen, Dallas, Tex.

[73] Assignee: Ginnie Johansen Designs, Inc., Dallas, Tex.

[21] Appl. No.: 316,818

[22] Filed: Nov. 2, 1981

[51] Int. Cl.[3] ..... A41F 3/02; A41F 9/00; A41F 15/00

[52] U.S. Cl. ..... 2/338; 2/301; 2/311; 2/319; 2/322; 2/DIG. 6; 128/DIG. 15

[58] Field of Search ..... 2/301, 311, 319, 322, 2/338, 318, 170, 220, 7, DIG. 6; 128/DIG. 15

[56] References Cited

U.S. PATENT DOCUMENTS

| | | | |
|---|---|---|---|
| 450,050 | 4/1891 | Whittaker | 2/318 |
| 1,543,399 | 6/1925 | Smith | 2/322 |
| 2,914,070 | 11/1959 | Kellner et al. | 2/311 |
| 3,086,529 | 4/1963 | Munz et al. | 2/338 X |
| 3,297,026 | 1/1967 | Van Pelt | 128/DIG. 15 |
| 3,866,276 | 2/1975 | Perkins | 2/311 |
| 4,040,124 | 8/1977 | Zoephel | 2/338 |
| 4,203,167 | 5/1980 | Collins | 2/322 |
| 4,371,983 | 2/1983 | Piotti | 2/DIG. 6 |

FOREIGN PATENT DOCUMENTS

| | | | |
|---|---|---|---|
| 1598696 | 9/1981 | United Kingdom | 2/338 |

*Primary Examiner*—Werner H. Schroeder
*Assistant Examiner*—Mary A. Ellis

[57] ABSTRACT

A waistband, such as a cummerbund comprising; a main band segment, first and second elongated band segments which are connected to said main band and two strips of mutually adhesive material used as an adjustment means. Additionally, the waistband includes a provision for maintaining the first and second elongated band segments closely adjacent and aligned when they are interconnected.

4 Claims, 4 Drawing Figures

FIG. 1
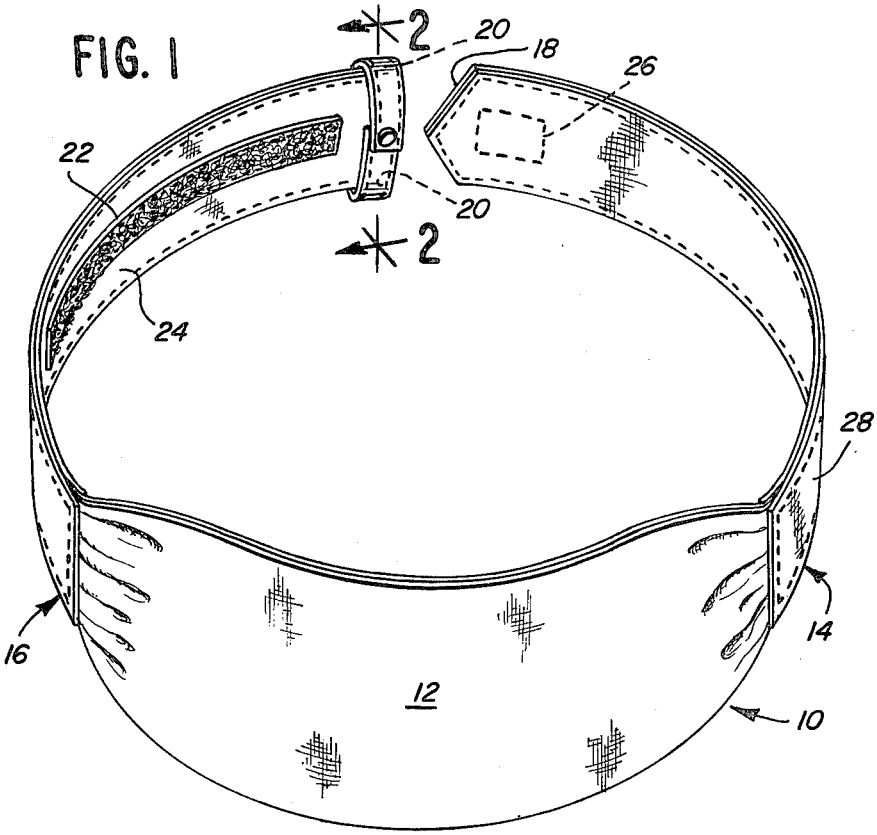
FIG. 2
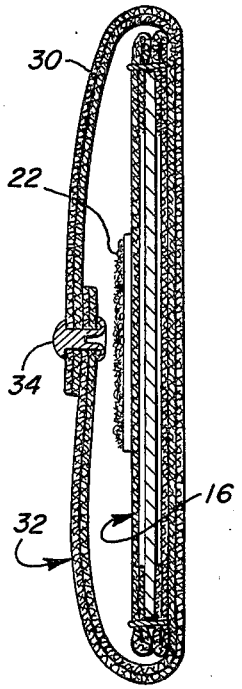
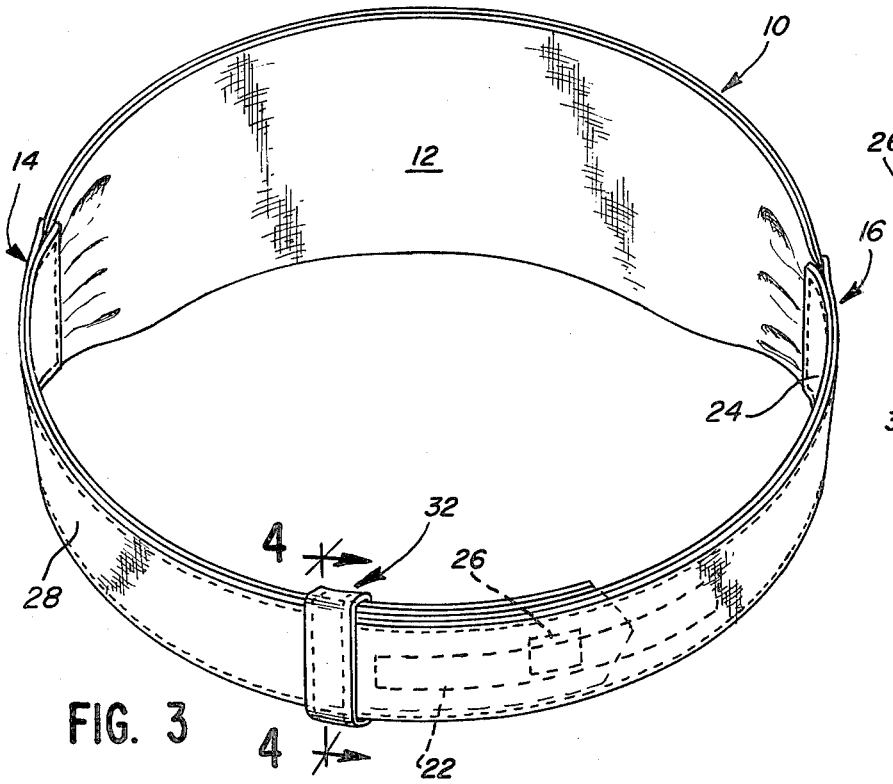
FIG. 3
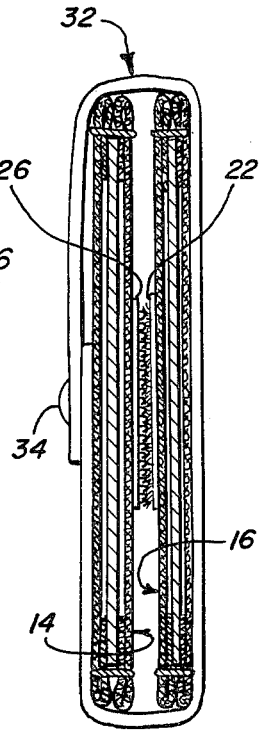
FIG. 4

CUMMERBUND

The present invention relates to an improved waistband construction and, more particularly, to a cummerbund waistband construction which enables the article to be manufactured in a single size while permitting the person wearing it to neatly and precisely fit the item about the waist.

Cummerbunds typically include a frontal or main band portion which extends across the waist and to the sides of the person wearing the item. The frontal band is held in place by means of extentions thereof in the form of belt-like bands which connect in the rear.

Cummerbunds are typically manufactured in various sizes, such as "small", "medium" and "large". Generally, the cummerbunds of each size are in turn size adjustable to some extent. Some, particularly those intended to be worn by men with formal dress, are provided with a friction buckle to allow for size adjustment of the rear bands or straps. The visual appearance of the straps is not important because they are covered by a jacket. However, women often wear cummerbunds without a jacket and, therefore, it is important to provide and maintain a neat visual appearance both front and rear. To provide a nice appearance, womens' cummerbunds often are secured in the rear by means of hooks affixed to one of the rear straps or band segments which engage threaded loops affixed to the other rear band segment. Some size adjustability is afforded by providing a series of spaced apart-threaded loops.

Because cummerbunds heretofore have of necessity been manufactured in a variety of sizes, retailers must stock a variety of the same selections in each size. To hold down inventory costs the retailer is forced often to stock only a few of the possible selections in each size range. The foregoing problem is especially accute in respect to cummerbunds intended for ladies wear.

SUMMARY OF THE INVENTION

It is an object of the present invention to provide a size adjustable waistband or cummerbund construction which obviates the need to manufacture such items in a variety of sizes while at the same time permitting the person wearing the item to precisely and neatly fit the item to the person.

In accordance with the present invention a waistband, such as a cummerbund, comprises a main band segment. First and second elongated band segments of common, substantially axially-uniform transverse dimension are connected to extend in opposite directions from the main band segment. Each of the elongated band segments has a free end and inner and outer faces. The waistband further includes relatively long and short strips of mutually adhesive material, such as Velcro brand material, with the relatively long strip being secured to the inner face of the second of the elongated segments to extend longitudinally therealong from a point adjacent the free end thereof. The relatively short strip is secured to the outer face of the first of the elongated segments adjacent its free end.

Such arrangement permits the elongated band segments to be adjustably interconnected in partially overlapping fashion through adhesive engagement of the relatively short strip with the relatively long strip at a selected location therealong so that the elongated band segments, together with the main band segment, jointly define a circumambient waistband of selected circumference. The waistband further includes provision for maintaining the free end of the second of the elongated band segments closely adjacent and aligned with the first of the elongated band segments when the same are interconnected.

In the preferred form illustrated herein, the free end of the second of the elongated band segments is closely maintained adjacent the other of the segments by means of a transverse loop formed at the end of the second of the elongated band segments. The loop receives and guides the other of the elongated band segments so that when the short strip is placed into engagement with the long strip at a preselected location, the first and second bands are maintained in a perfectly aligned relation insuring a neat appearance.

Other features and advantages of the invention will be apparent from the following description and claims and are illustrated in the accompanying drawings which show structure embodying preferred features of the present invention and the principles thereof, and what is now considered to be the best mode in which to apply these principles.

BRIEF DESCRIPTION OF THE DRAWINGS

In the accompanying drawings forming the part of the specification, and in which like numerals are employed to designate like parts throughout the same:

FIG. 1 is a perspective view illustrating a cummerbund in accordance with the present invention;

FIG. 2 is a sectional view taken, as indicated, along the line 2—2 of FIG. 2;

FIG. 3 is a perspective view of the cummerbund of FIG. 1 shown with the elongated band segments in their interconnected condition; and FIG. 4 is a sectional view taken as indicated, along the line 4—4 of FIG. 3.

DETAILED DESCRIPTION

Referring now to the drawings the invention is shown for purposes of illustrative disclosure incorporated in a cummerbund 10 that includes a frontal or main band segment 12 of fabric material. First and second elongated band segments 14, 16 of common, substantially axially-uniform transverse dimension are connected to extend in opposite directions from the main band segment 12. Each of the segments 14, 16 has a free end 18, 20, respectively, with the opposite ends thereof being stitched to the main band segment 12. A relatively long strip of connector or adhesive material 22 is stitched to the inner face 24 of the second of the elongated band segments 16 to extend longitudinally therealong from a point adjacent the free end 20 thereof. A relatively short strip 26 of cooperating connector or adhesive material is affixed to the outer face 28 of the first of the elongated band segments 14 adjacent the free end 18 thereof.

The relatively long and short strips 22, 26 may be of any suitable mutually adhesive material, such as Velcro brand adhesive material, the components of which mutually adhere to each other when in contact but do not adhere to different materials. Typically, such mutually adhesive materials include a first material component presenting a surface of closely spaced looped filaments and a second material component presenting a surface of hook-like projections. When placed into contact, the hook-like projections engage the looped filaments to provide a firm connection while permitting the cooperating materials to be pulled apart.

As best illustrated in FIGS. 2 and 4, the first and second elongated band segments each consist of layers of stitched-together material, one of such layers of which may be relatively stiff fabric to provide body to the band segment. The strips of mutually adhesive material 22, 26 are stitched to the respective band segments equi-distant between the sides thereof.

A length of fabric material 30 is stitched to the second of the band segments 16 at the end thereof and is folded to form a loop 32, a suitable connector 34 interconnecting the ends of the length 30. Loop 32 encircles the inner and outer faces of the second of the band segments 16 and serves to receive and guide the first of the elongated band segments 14 so that when the short strip 26 is pressed engagement with the long strip 22 at a selected location therealong the first and second band segments 14, 16 are maintained in a properly aligned orientation which in turn ensures a neat appearance.

It will now be apparent that there has been disclosed an improved waistband construction which avoids the disadvantages of prior constructions and which achieves the foregoing objects. In this connection it should be understood that, while a specific preferred embodiment has been disclosed herein, various changes and variations may readily be made without departing from the spirit and scope of the appended claims.

What is claimed is:

1. In a waistband having a main band segment, the combination comprising first and second elongated band segments of common, substantially axially-uniform transverse dimension connected to extend in opposite directions from said main band segment, each of said segments having a free end and inner and outer faces, relatively long and short strips of mutually adhesive material, the relatively long strip of said material being secured to the inner face of the second of said segments to extend longitudinally therealong from a point adjacent the free end thereof, the relatively short strip of said material being secured to the outer face of the first of said segments adjacent the free end thereof, whereby said segments may be adjustably interconnected in partially overlapping fashion through adhesive engagement of said relatively short strip with said relatively long strip at a selected location therealong to thereby jointly define with the main band segment a circumambient waistband of selected circumference, and means affixed to the second of said segments to engagingly receive in slidable relation the first of said segments for maintaining the free end of the second of said segments closely adjacent an intermediate length portion of the first of said segments when the same are interconnected and said short strip is remote therefrom.

2. In a waistband in accordance with claim 1 wherein said means comprises material affixed to the free end of the second of said segments forming a transverse loop that encircles said first and second segments when the same are interconnected.

3. In a waistband in accordance with claim 2 wherein the main band comprises the frontal portion of a cummerbund.

4. In a waistband in accordance with claim 1 wherein said means comprises loop defining means affixed at the free end portion of the second of said segments for guidingly receiving the free end length portion of the first of said segments therethrough and cooperable with said strips to maintain said segments in aligned relative relation when said segments are interconnected.

* * * * *